US005305070A

United States Patent [19]

Snelling

[11] Patent Number: 5,305,070

[45] Date of Patent: Apr. 19, 1994

[54] COLOR SELECT DEVELOPMENT AND SYSTEM APPLICATION

[75] Inventor: Christopher Snelling, Penfield, N.Y.

[73] Assignee: Xerox Corporation, Stamford, Conn.

[21] Appl. No.: 75

[22] Filed: Jan. 4, 1993

[51] Int. Cl.[5] ..... G03G 15/01

[52] U.S. Cl. ..... 355/326 R; 355/208; 355/246; 355/327; 355/259; 346/157

[58] Field of Search ..... 355/326, 327, 328, 259, 355/245, 246, 208; 346/157, 160.1; 430/42, 43; 354/326 R

[56] References Cited

U.S. PATENT DOCUMENTS

| | | | |
|---|---|---|---|
| 4,078,929 | 3/1978 | Gundlach | 96/1.2 |
| 4,546,722 | 10/1985 | Tuda et al. | 118/657 |
| 4,568,955 | 2/1986 | Hosoya et al. | 346/153.1 |
| 4,761,672 | 8/1988 | Parker et al. | 430/42 X |
| 4,806,973 | 2/1989 | Kishimoto et al. | 346/157 |
| 4,811,046 | 3/1989 | May | 355/326 |
| 4,833,503 | 5/1989 | Snelling | 355/259 |
| 4,961,094 | 10/1990 | Yamaoki et al. | 355/326 |
| 4,987,456 | 1/1991 | Snelling et al. | 355/273 |
| 5,010,367 | 1/1991 | Hays | 355/247 |
| 5,012,299 | 4/1991 | Sawamura et al. | 355/326 |
| 5,053,824 | 10/1991 | Schram | 355/259 |
| 5,061,969 | 10/1991 | Parker et al. | 355/328 |
| 5,080,988 | 1/1992 | Germain et al. | 355/328 X |
| 5,122,842 | 6/1992 | Rimai et al. | 430/43 X |
| 5,155,541 | 10/1992 | Loce et al. | 355/326 X |
| 5,176,974 | 1/1993 | Till et al. | 430/42 |
| 5,194,905 | 3/1993 | Brewington | 355/326 |

FOREIGN PATENT DOCUMENTS 0291267 11/1989 Japan .

*Primary Examiner*—Matthew S. Smith

[57] ABSTRACT

Color image creation using tri-level images wherein the image color is user selectable. Selection of a desired color establishes the voltage bias of a plurality of developer structures which, in turn, determines how much of each successive color toner is deposited on a particular image.

10 Claims, 4 Drawing Sheets

COLOR SELECT DEVELOPMENT AND SYSTEM APPLICATION

BACKGROUND OF THE INVENTION

The invention relates to electronic copying/printing systems and more particularly to an electronic multicolor copying/printing system and non-interactive development systems therefor.

The invention can be utilized in the art of xerography or in the printing arts. In the practice of conventional xerography, it is the general procedure to form electrostatic latent images on a xerographic surface by first uniformly charging a photoreceptor. The photoreceptor comprises a charge retentive surface. The charge is selectively dissipated in accordance with a pattern of activating radiation corresponding to original images. The selective dissipation of the charge leaves a latent charge pattern on the imaging surface corresponding to the areas not exposed by radiation. The areas of charge dissipated on the photoreceptor correspond to residual or background voltage levels. Thus, the photoreceptor may, in a digital printer, contain two voltage levels while in a light/lens machine there is a vast array of levels.

This latent charge pattern is rendered visible by developing it with toner. The toner is generally a colored powder which adheres to the charge pattern by electrostatic attraction.

The developed image is then fixed to the imaging surface or is transferred to a receiving substrate such as plain paper to which it is fixed by suitable fusing techniques.

Conventional xerographic imaging techniques which were directed to monochrome image formation have been extended to the creation of color images including highlight color images. In one method of highlight color imaging, the images are created using a raster output scanner to form tri-level images including a pair of image areas and a background area intermediate the two image areas.

The concept of tri-level, highlight color xerography is described in U.S. Pat. No. 4,078,929 issued in the name of Gundlach. The patent to Gundlach teaches the use of tri-level xerography as a means to achieve single-pass highlight color imaging. As disclosed therein the charge pattern is developed with toner particles of first and second colors. The toner particles of one of the colors are positively charged and the toner particles of the other color are negatively charged. In one embodiment, the toner particles are supplied by a developer which comprises a mixture of triboelectrically relatively positive and relatively negative carrier beads. The carrier beads support, respectively, the relatively negative and relatively positive toner particles. Such a developer is generally supplied to the charge pattern by cascading it across the imaging surface supporting the charge pattern. In another embodiment, the toner particles are presented to the charge pattern by a pair of magnetic brushes. Each brush supplies a toner of one color and one charge. In yet another embodiment, the development systems are biased to about the background voltage. Such biasing results in a developed image of improved color sharpness.

In highlight color xerography as taught by Gundlach, the xerographic contrast on the charge retentive surface or photoreceptor is divided into three levels, rather than two levels as in the case in conventional xerography. The photoreceptor is charged, typically to −900 volts. It is exposed imagewise, such that one image corresponding to charged image areas (which are subsequently developed by charged-area development, i.e. CAD) stays at the full photoreceptor potential ($V_{CAD}$ or $V_{ddp}$). $V_{ddp}$ is the voltage on the photoreceptor due to the loss of voltage while the photoreceptor remains charged in the absence of light, otherwise known as dark decay. The other image is exposed to discharge the photoreceptor to its residual potential, i.e. $V_{DAD}$ or Vc (typically −100 volts) which corresponds to discharged area images that are subsequently developed by discharged-area development (DAD) and the background area is exposed such as to reduce the photoreceptor potential to halfway between the $V_{CAD}$ and $V_{DAD}$ potentials, (typically −500 volts) and is referred to as $V_{white}$ or $V_w$. The CAD developer is typically biased about 100 volts closer to $V_{CAD}$ than Vwhite (about −600 volts), and the DAD developer system is biased about −100 volts closer to $V_{DAD}$ than $V_{white}$ (about 400 volts). As will be appreciated, the toners used in a system such as described above need not comprise different colors but may have other distinguishing characteristics. For example, both toners could be black but one toner may be magnetic and the other non-magnetic.

The above described tri-level imaging process is utilized in the 4850 TM printer. This printer is capable of creating images with black toner and one of several highlighting colors. Since the printer can only have two, one black and one color, developer housings installed at any one time, changing color from job to job typically requires recharging the color development system with a new, different color developer material having toner of the proper color or replacing the whole development system with one already charged with developer having toner of the desired color. Color changes from job to job are time consuming for the "recharge" technique and the use of multiple development subsystems requires storage space.

Non-interactive development systems are know U.S. patent application Ser. No. 07/619,649 filed on Nov. 29, 1990 in the name of Grace T. Brewington and assigned to the same assignee as the instant application discloses color image creation using a plurality of non-interactive developer structures wherein the color is user selectable. Selection of a desired color establishes the duty cycle of each of a plurality of developer structures which, in turn, determines how much, if any, of each color toner is deposited on a particular image. The duty cycle of each developer structure may vary between zero and a predetermined maximum time which corresponds to the time it takes for an image area on a charge retentive surface to move through a development nip intermediate the charge retentive surface and one of the developer structures.

A number of U.S. patents which appear to be relevant to various aspects of the present invention disclosed herein are discussed below.

U.S. Pat. No. 5,012,299 granted to Sawamura et al on Apr. 30, 1991 discloses a color adjustment apparatus for a color copying machine including a touch-key for inputting color adjustment data which causes the values for exposure and main-charge outputs and development bias to be varied in accordance with a correction to be made.

U.S. Pat. No. 4,546,722 granted on Oct. 15, 1985 to Toda et al discloses a development apparatus having a toner carrying member and a piezoelectric vibrator for displacing toner from the toner carrying member and causing it to fly in a manner to avoid depositing toner onto a non-image area of an image bearing surface. Such an arrangement prevents degradation of the charged image for the purpose of image preservation. The apparatus avoids adverse influences upon the electrostatic latent image so as not to cause disturbance in the resulting image if applied in a multiple copy per exposure process to produce a plurality of copies. This apparatus is non-interactive from a latent electrostatic image preservation standpoint, but does not appear to be non-interactive from a developed toner image standpoint, and therefore, would seem to allow unwanted scavenging of multi-colored toner to occur. This apparatus seems to be designed to prevent degradation of the charged image for the purpose of latent image preservation and not for the purpose of preventing degradation of the toned image pattern.

U.S. Pat. No. 4,833,503 granted to Christopher Snelling on May 23, 1989 relates to a multi-color printer using a sonic toner release development system to provide either partial or full color copies with minimal degradation of developed toner patterns by subsequent over-development with additional colors and minimal back contamination of developer materials. Multiple scanning beams, each modulated in accordance with distinct color image signals, are scanned across the printer's photoreceptor at relatively widely separated points, there being buffer means provided to control timing of the different color image signals to assure registration of the color images with one another. Each color image is developed prior to scanning of the photoreceptor by the next succeeding beam. After developing of the last color image, the composite color image is transferred to a copy sheet. Development is accomplished by vibrating the surface of a toner carrying member thereby reducing the net force of adhesion of toner to the surface of the toner carrying member. By appropriately limiting the magnitude of vibration of the toner carrying member in this development system toner will be released from the surface only in those areas in proximity to image areas where toner deposition is actually desired. Thus, selective clouds of toner may be made to occur only in correspondence with those image areas that are actually to be developed by toner deposition onto them.

U.S. Pat. No. 4,987,456 granted to Snelling et al on Jan. 22, 1991 relates to a resonator suitable for generating vibratory energy which is arranged in line contact with the back side of a charge retentive member bearing an image on a surface thereof, in an electrophotographic device, to uniformly apply vibratory energy to the charge retentive member. The resonator comprises a vacuum producing element, a vibrating member, and a seal arrangement. Where the vibratory energy is to be applied to the charge retentive surface, a vacuum is applied by the vacuum producing element to draw the surface into intimate engagement with the vibrating member, and edge seal arrangement. The invention has application to a transfer station of enhancing electrostatic transfer of toner from the charge retentive surface to a copy sheet, and to a cleaning station, where mechanical vibration of the surface will improve the release of residual toner remaining after transfer.

U.S. Pat. No. 4,568,955 issued on Feb. 4, 1986 to Hosoya et al discloses a recording apparatus wherein a visible image based on image information is formed on an ordinary sheet by a developer. The recording apparatus comprises a donor roller spaced at a predetermined distance from and facing the ordinary sheet and carrying the developer thereon, a recording electrode and a signal source connected thereto, for propelling the developer on the developing roller to the ordinary sheet by generating an electric field between the ordinary sheet and the developing roller according to the image information, a plurality of mutually insulated electrodes provided on the developing roller and extending therefrom in one direction, an AC and a DC source are connected to the electrodes, for generating an alternating electric field between adjacent ones of the electrodes to cause oscillations of the developer found between the adjacent electrodes along electric lines of force therebetween to thereby liberate the developer from the developing roller thereby forming the toner particles into smoke in the vicinity of the donor roller and the sheet.

U.S. Pat. No. 5,010,367 granted to Dan A. Hays on Apr. 23, 1991 relates to a non-interactive or scavengeless development system for use in color imaging. To control the developability of lines and the degree of interaction between the toner and receiver, an AC voltage is applied between a donor roll and electrodes supported adjacent to the surface of said donor roll to enable efficient detachment of toner from the donor to form a toner cloud. An AC voltage applied between the donor roll assembly and an image receiver serves to position the cloud in close proximity to the image receiver for optimum development of lines and solid areas without scavenging a previously toned image.

With those non-interactive development systems discussed above that create uniform powder clouds in the development zone it is difficult to measure and to define the appropriate developer bias to optimize development. This is because toner clouds create a space charge in the development zone which affects the desired value of voltage bias applied to development systems. The space charge must be taken into account when setting the developer bias. Thus, the magnitude of the space charge, which can not be accurately determined, adversely affects the developer bias.

BRIEF SUMMARY OF THE INVENTION

Briefly, in accordance with the present invention, a color printing apparatus and non-interactive development system therefor is provided. The development system is characterized by the capability of variable toner deposition or color selection as a function of developer bias variations.

"Color Select" development is effected using, for example, four developer structures comprising black, magenta, yellow and cyan toners. All but one of these structures are non-interactive and, unlike prior art devices, they create selective clouds of toner in the development zone.

Developed image colors are created "on the fly" by sequentially stacking toners onto the "color" image areas of a tri-level image in proportions appropriate for the desired color. The foregoing is achieved by sequentially staggering the levels of "effective" DC developer bias in proportion to the desired color mix. "Effective" developer bias, is defined as the potential difference between the surface potential of the already partially developed toner image and the subsequent color development bias (after the first color toner is deposited). The fundamental principal of "Color Select" development is, therefore, the controlled superposition of toners from several non-interactive development subsystems to create the desired color of images on the fly to facilitate color/job changes.

In order to more optimally control the development biases of the individual development structures, the surface potential ($V_t$) of the layer of toner loaded on the donor belt forming a part of each developer structure is measured. The values of $V_t$ must be considered in order to determine the optimal biases to be used for each developer structure. This is because the electrostatic development field V/D across the air gap between the image receptor and the respective donor surfaces of the developer structures is effected by the value of $V_t$. The value of $V_t$ also provides a measure of the Mass/Area toner loading on the donor.

The particular color to be applied to an image is user selectable. The user selects a desired color from a palette of colors. Color information is supplied via a User Interface (UI) to a controller where computer logic and algorithms determine the operating state of each of the developer housings.

DETAILED DESCRIPTION OF THE PREFERRED EMBODIMENT OF THE INVENTION

Figure 1:
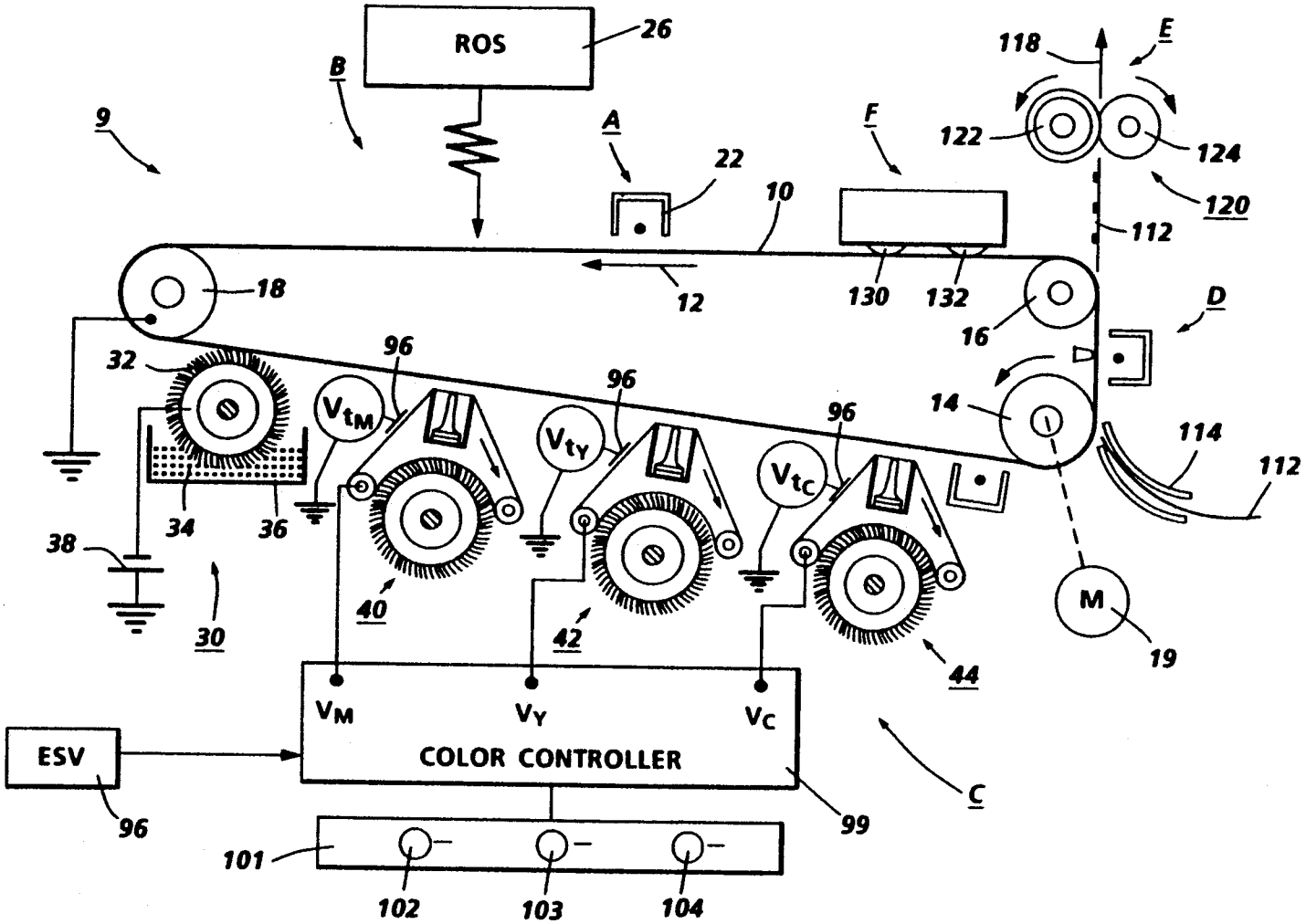
FIG. 1 is schematic illustration of a color imaging apparatus incorporating the invention.

This invention relates to an imaging system which is used to produce a color output in a single pass. It will be understood that it is not intended to limit the invention to the embodiment disclosed. On the contrary, it is intended to cover all alternatives, modifications and equivalents as may be included within the spirit and scope of the invention as defined by the appended claims. FIG. 1 schematically depicts the various components of an illustrative electrophotographic copying machine incorporating the sonic toner release development apparatus of the present invention therein.

As shown in FIG. 1, an electrophotographic printing machine 9 incorporating the invention comprises a monopolar photoreceptor belt 10 having a photoconductive surface formed on a conductive substrate. Belt 10 moves in the direction indicated by arrow 12, advancing sequentially through the various xerographic process stations. The belt is entrained about a drive roller 14 and two tension rollers 16 and 18 the former of which is operatively connected to a drive motor 19.

With continued reference to FIG. 1, a portion of belt 10 passes through charging station A where a corona generating device, indicated generally by the reference numeral 22, charges the photoconductive surface of belt 10 to a relative high, substantially uniform, negative potential.

Next, the uniformly charged portions of the photoreceptor surface are advanced through exposure station B. At exposure station B, the uniformly charged photoreceptor or charge retentive surface 10 is exposed to a laser based input and/or output scanning device 26 which causes the charge retentive surface to be discharged in accordance with the output from the scanning device. Preferably the scanning device is a three level laser Raster Output Scanner (ROS). Alternatively, the ROS could be replaced by a conventional xerographic exposure device.

The photoreceptor, which is initially charged to a voltage $V_0$, undergoes dark decay to a level $V_{ddp}$ equal to about −900 volts. When exposed at the exposure station B it is discharged to $V_c$ equal to about −100 volts which is near zero or ground potential in the highlight (i.e. color other than black) color parts of the image. The photoreceptor is also discharged to $V_w$ equal to approximately −500 volts imagewise in the background (white) image areas.

At development station C, a magnetic brush development system, indicated generally by the reference numeral 30 advances developer material into contact with the electrostatic latent images. The development system 30 comprises one or more magnetic brushes 32 and a supply or two-component developer 34 contained in a developer housing 36. The developer 34 comprises a mixture of carrier beads and black toner particles together with additives as needed for a specific application. Black toner particles which are positively charged are deposited on the charged area or CAD images of the tri-level images formed with the ROS. Magnetic brush development which is an interactive system is suitable for developing the CAD images because it is the first developer system. Thus, already developed images do not have to move past that developer housing. A suitable negative developer bias is applied to the developer system 30 via a DC power source 38.

The discharged area or DAD images, unlike the CAD image, are preferably developed using non-interactive development systems 40, 42 and 44 adapted to deposit varying amounts of color toner particles onto the DAD portion of the tri-level image. For, example these non-interactive developer systems may deposit negatively charged, magenta, yellow and cyan toners in a spot on spot manner on the DAD images.

Figure 2:
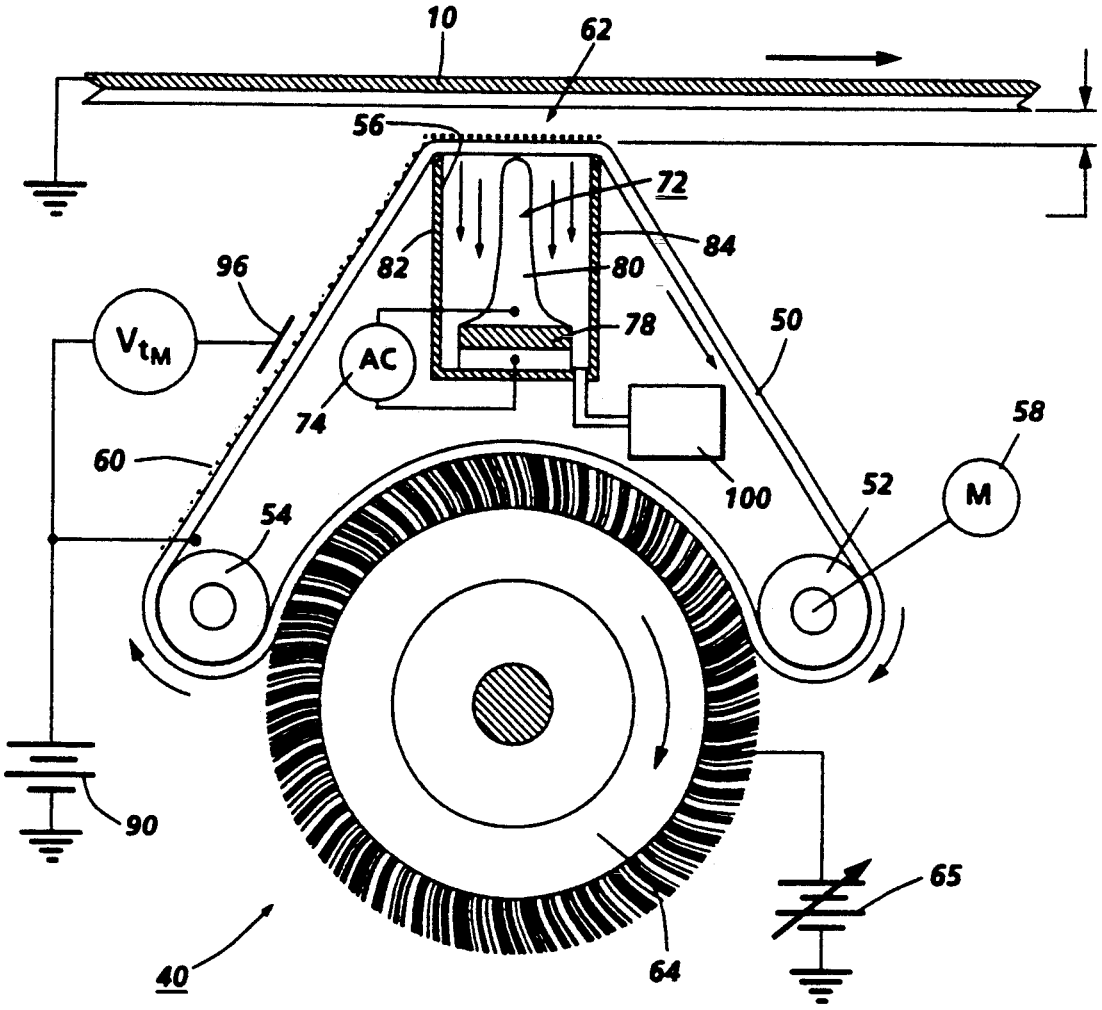
FIG. 2 is a schematic illustration of a developer structure incorporated in the embodiments of FIGS. 1 and 2.

Each of the development systems 40, 42 and 44 is identical with the exception of the color toner which is deposited thereby. As illustrated in FIG. 2, the development system 40 comprises a donor belt 50 entrained about a pair of rollers 52 and 54 and a vacuum coupling chamber 56. A motor 58 operatively connected to one of the rollers, for example roller 52, effects movement of the belt in a clockwise motion for transporting toner particles 60 to a development zone 62 intermediate the donor belt and the photoreceptor belt 10. The donor belt 50 may be fabricated from a material such as aluminized Mylar TM with a coating which is insulative enough to allow the use of conductive magnetic brush loading.

A magnetic brush structure 64 electrically biased via a DC source 65 is provided for loading the donor belt with the appropriate toner. This bias can be adjusted for varying the quantity of toner loaded on the donor belt.

An acoustic wave-guide or resonator structure 72 to which an AC voltage 74 is coupled is disposed within the a vacuum coupling chamber 56 and serves to vibrate the donor belt for liberating toner therefrom. The acoustic wave-guide provides sonic release of toner from the donor. The underlying principle of sonic toner release resides in the reduction of the net force of toner particle adhesion to the donor belt surface. Sufficient reduction of the net force of adhesion of toner to the donor surface enables $_qE$ electrostatic image forces to selectively remove toner from the donor. The wave-guide structure comprises a piezoelectric transducer 78 fabricated from lead zirconium titanate (PZT) or other piezoelectric material and a segmented horn 80 that can be fabricated from aluminum. The AC bias voltage 74 is applied to the piezoelectric member 78 for effecting vibration of the horn and, in turn the belt. Upstanding walls 82 and 84 of the vacuum coupling chamber 56 through their contact with the donor belt 50 dampen belt vibration beyond these areas of contact with the belt. The transducer is excited over a range of frequencies based on the expected natural excitation frequencies of the horn 80. The piezoelectric transducer may be excited by sweeping a sine wave signal over a range of frequencies from 20 KHz to 200 KHz.

In sonic toner release development, use is made of motions of a charged particle bearing surface (donor belt) to counteract forces adhering the particles to the surface. Those motions can be adjusted in magnitude such that particles continue to adhere to the donor surface unless they are additionally effected by an electrostatic field of appropriate direction and magnitude to remove them from the donor. In the case where the electrostatic field is due to proximity of an electrostatic image, the released toner will selectively deposit on the image, thereby.

The selective toner removal characteristics of sonic toner release development distinguish it from powder cloud (and jumping) development where airborne toner is presented to the entire receptor regardless of it's potential. This distinction provides an important copy quality advantage with sonic toner release since wrong sign and non-charged toner deposition is inhibited. In addition, interaction effects between successive developments with different toners (colors) are minimal.

Where the belt is vibrated a vacuum source 100 is energized for drawing air through the vacuum coupling chamber in the direction of the arrows. The vacuum has the effect of pulling the belt into intimate contact with the upstanding walls 82 and 84 and the tip of the acoustic wave-guide. Thus, the portions of the donor belt positioned beyond the edges of the walls 84 and 86 exhibit little if any vibratory motion thereby precluding pre and post-development toner clouding.

Figure 3:
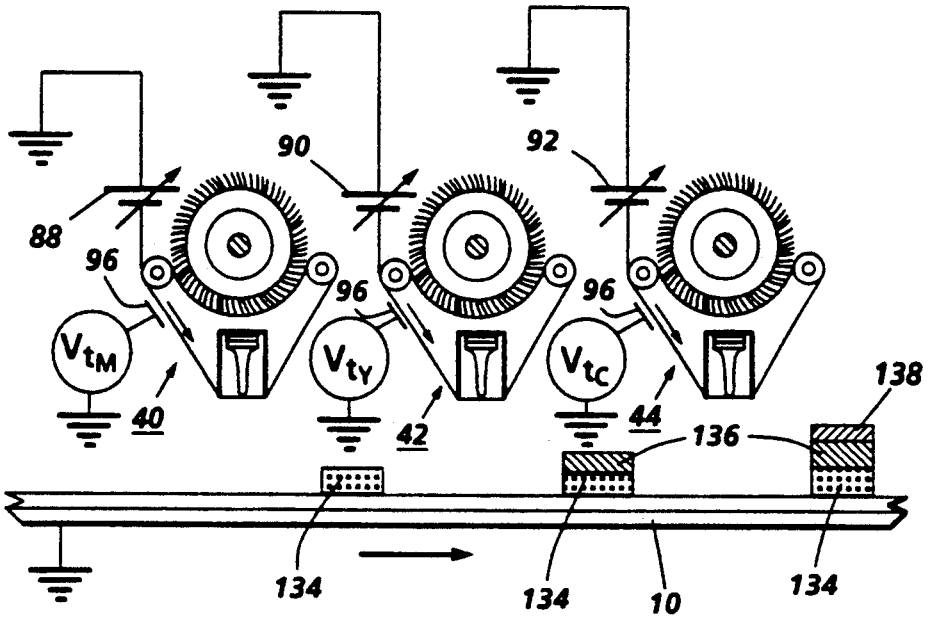
FIG. 3 illustrates the development steps for forming a spot on spot color image using non-interactive development systems for depositing three color toners.

Each developer system is electrically biased via one of a plurality of DC power sources 88, 90 and 92. The power source 88 is used for applying a voltage, $V_M-V_{tM}$ to the magenta developer structure 40. $V_{tM}$ is surface potential of the layer of toner loaded on the donor belt for the developer structure 40. The power source 90 is used for applying a voltage, $V_Y-V_{tY}$ to the Yellow developer structure 42 while the power source 92 is used for applying a bias voltage, $V_C-V_{tC}$ to the Cyan developer structure 44 as illustrated in FIG. 3. $V_{tY}$ is the surface potential of the layer of toner loaded on the donor belt for the developer structure 42 while $V_{tC}$ is the surface potential of the layer of toner loaded on the donor belt for the developer structure 44. The electrical biases are variable in the range of $--100$ to $-600$ in accordance with the amount of toner of a particular color to be deposited. In other words, the quantity of toner deposited on a discharged area (DAD) image can be varied in accordance with one aspect of the invention by varying the developer bias. The use of this range of developer biases is enabled by the sensitivity of the sonic toner release system of development.

An electrostatic voltmeter (ESV) 96 is provided for measuring the surface potential of the layer of toner loaded onto the donor belt surface. Since this toner surface potential is effectively in series with the externally applied developer bias, appropriate adjustment must be made to the applied bias. Typical surface potentials are in the order of 50 to 80 volts.

The unwanted bias effect of the measured potential is thus suppressed by reducing the applied bias by this value.

A color controller 99 (FIG. 1) and user interface (UI) 101 provide means for user selection of the final color for the DAD image. The UI comprises a plurality of control knobs 102, 103 and 104, one for each non-interactive development system. By reference to a color palette, not shown, the user can obtain the settings for the control knobs. For example, once a specific color is identified by the user the setting of these knobs determines the individual biases for the development systems. As noted above, the charged toner on the donor belt affects this setting. Thus, electrical signals generated by the ESV 96 which provide an analog representation of the surface potential on the donor belt are used to adjust the developer bias. The analog signals generated by ESV 96 are transmitted to the controller and used thereby to adjust the developer biases. As will be appreciated, a single knob could be employed to control output image color hue by virtue of the ratio of color toner constituents. Digital information representing each of the developer biases to be applied could be stored in computer memory within the controller. Thus, when a setting is made the appropriate biases are automatically applied to the respective developer structures.

Since the photoreceptor contains both positive and negative toner particles thereon, a pre-transfer corotron 110 is provided for effecting a unipolar image prior to transfer.

Referring again to FIG. 1, after the electrostatic latent image has been subjected to the pre-transfer corona emissions, the photoreceptor belt advances the toner powder images to transfer station D. A copy sheet 112 is advanced to transfer station D by sheet feeding apparatus, not shown. Preferably, sheet feeding apparatus includes a feed roll contacting the uppermost sheet of a stack of sheets. The feed roll rotates to advance the uppermost sheet from stack into chute 114. Chute 114 directs the advancing sheet of support material into contact with photoconductive surface of belt 10 in a timed sequence so that the toner powder images developed thereon contact the advancing sheet at transfer station D. Transfer station D includes a corona generating device 116 which sprays ions onto the back side of sheet 112. This attracts the toner powder image from photoconductive surface 10 to sheet 112. After transfer, sheet 112 continues to move in the direction of arrow 118 onto a conveyor (not shown) which advances sheet 112 to fusing station E.

Fusing station E includes a fuser assembly, indicated generally by the reference numeral 120, which permanently affixes the transferred powder image to sheet 112. Fuser assembly 120 includes a heated fuser roller 122 and back-up roller 124. Sheet 112 passes between fuser roller 122 and back-up roller 124 with the toner powder image contacting fuser roller 122. In this manner, the toner powder image is permanently affixed to sheet 112. After fusing, sheet 112 advances through a chute, not shown, to catch tray, also not shown, for subsequent removal from the printing machine by the operator.

After the copy sheet is separated from photoconductive surface of belt 10, the residual toner particles adhering to photoconductive surface of belt 10 are removed therefrom at cleaning station F. Cleaning station F may include a rotatably mounted fibrous brush, not shown, in contact with photoconductive surface. The particles are cleaned from photoconductive surface by the rotation of the brushes 130 and 132 in contact therewith. Subsequent to cleaning, a discharge lamp (not shown) floods the photoreceptor with light to dissipate any residual electrostatic charge remaining thereon prior to the charging thereof for the next successive imaging cycle.

Figure 5:
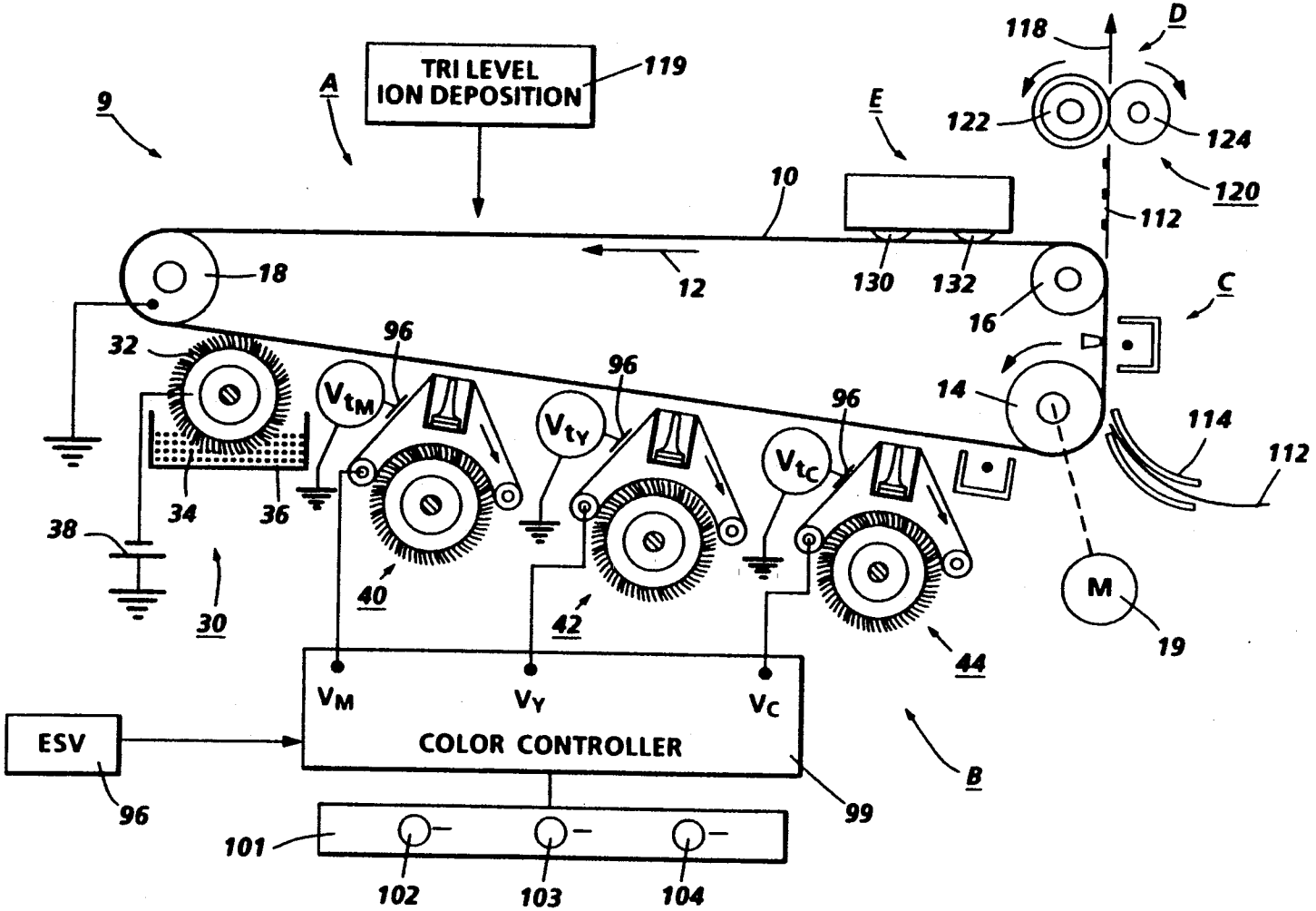
FIG. 5 is a schematic illustration of a modified embodiment of the color imaging apparatus of FIG. 1.

A modified embodiment of the invention as illustrated in FIG. 5 differs from the embodiment disclosed in FIG. 1 solely in the manner in which the latent electrostatic images are formed. In lieu of using the ROS 26 for forming these images, a highlight color ionographic printer 119 is employed. Suitable ionographic printers for creating the desired latent images are disclosed in U.S. Pat. Nos. 4,837,591 and 4,879,194 granted to Christopher Snelling on Jun. 6, 1989 and Nov. 7, 1989, respectively.

Figure 4:
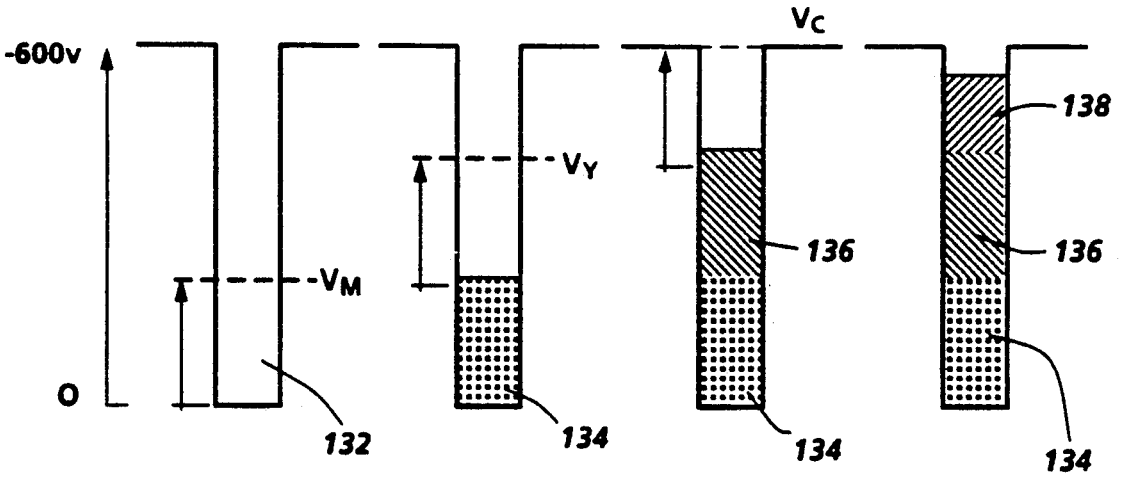
FIG. 4 illustrates a voltage profile of a typical DAD image showing the sequence of toner deposition on such an image.

A spot on spot color image forming process according to the invention is depicted in FIGS. 3 and 4. With the developer systems 40, 42 and 44 biased to $V_M$ $V_Y$ and $V_C$, respectively, a predetermined amount of magenta, yellow and cyan toners are deposited on the DAD image thereby yielding a composite image 130 which corresponds to the color chosen from the palette. Typical biases $V_M$, $V_Y$ and $V_C$ for the developer structures are in the order of −100 to −600 volts, respectively. As shown in FIG. 3, the developer biases are increased in the sequence from the developer structure 40 to the developer structure 44.

Thus, a DAD electrostatic image represented by the voltage profile 132 (FIG. 4) formed on the photoconductive surface with the ROS 26 is first developed with a quantity of magenta toner 134 using the developer structure 40. The developer structure 40 is biased to a voltage level, $V_M - V_{tM}$ via the power source 88. $V_M$ is is typically about −100 volts.

Next yellow toner 136 is deposited on top of the magenta toner 134 with the developer structure 42. The developer structure 42 is biased via DC power source 90 to a voltage bias, $V_Y - V_{tY}$ having a value, by way of example, of approximately −250 volts.

Finally, cyan toner 138 is deposited on top of the previously deposited toner with the developer structure 44. The developer structure 44 is biased to a DC voltage level, $V_C - V_{tC}$ of approximately −600 volts via power source 92. The composite color toner image is depicted in the last of the voltage profiles 132 shown in FIG. 4.

Due to the selective nature of toner cloud generation, as disclosed above, the effect of toner cloud space charge in the development zone is minimal. Thus, measurement of the toner surface potentials Vt on the donor belts prior to entry into the development zone provides information that enables the accurate identification and establishment of optimal operating biases.

While the invention has been described in connection with the preferred embodiments wherein color images are created it should be appreciated that it is not intended that the claims be so limited. For example, the concept of using an electrostatic voltmeter (ESV) for measuring the surface potential of the layer of toner loaded onto the donor belt surface could be employed in a monochrome imaging apparatus. In such a device the magnetic brush developer structure used for developing the black toner image would be replaced by a non-interactive developer structure such as one of the developer structures 40, 42 or 44. Also, compensation for the effect of surface potential on the donor could also used in a highlight color imaging arrangement where black toner images along with a single color image are formed. Both the black an single color image could be developed with non-interactive development systems as disclosed herein or the black could be developed using a magnetic brush development structure while using a non-interactive one for developing the single color image.

What is claimed is:

1. Apparatus for creating color images in a single pass of a charge retentive surface past a plurality of process stations, said apparatus comprising:
   - a charge retentive surface;
   - means for forming latent electrostatic images on said charge retentive surface;
   - a plurality developer structures, each including a donor member for conveying charged toner particles of a different color from the other developer structures for depositing toner particles in a spot on spot manner onto said latent electrostatic images;
   - means for electrically biasing each of said developer structures;
   - means for controlling the electrical bias for each developer structure at different voltage levels whereby varying amounts of toner may be deposited on said latent electrostatic images from each of said developer structures in accordance with the color of the image to be created;
   - means for generating signals representative of the surface potential of the donor member for each of said developer structures; and
   - means responsive to said signals for adjusting the biases applied to said developer structures for compensating for the effects of said surface potential on each development structure.

2. Apparatus according to claim 1 wherein said means for electrically biasing each of said developer structures comprises means for applying successively larger biases.

3. Apparatus according to claim 1 wherein the donor member for each of said developer structures comprises a belt.

4. Apparatus according to claim 3 including means for vibrating said belt in such a manner as to selectively create toner clouding in areas of said belt corresponding to toner attracting latent image areas on said charge retentive surface.

5. Apparatus according to claim 1 wherein said signal generating means comprises an electrostatic voltmeter.

6. Apparatus according to claim 5 wherein said charge retentive surface comprises a photoreceptor and said apparatus further comprises means for uniformly charging said charge retentive surface.

7. Apparatus for creating color images in a single pass of a charge retentive surface past a plurality of process stations, said apparatus comprising:

a charge retentive surface;

means for forming latent electrostatic images on said charge retentive surface;

a plurality developer structures, each including a donor member for conveying charged toner particles of a different color from the other developer structures for depositing toner particles in a spot on spot manner onto said latent electrostatic images;

means for electrically biasing each of said developer structures;

means for controlling the electrical bias for each developer structure at different voltage levels whereby varying amounts of toner may be deposited on said latent electrostatic images from each of said developer structures in accordance with the color of the image to be created means for loading toner particles onto said donor member and means for electrically biasing said toner loading means; and means for varying the electrical bias of said toner loading means.

8. A method for creating color images in a single pass of a charge retentive surface past a plurality of process stations, said method comprising:

forming latent electrostatic images on said charge retentive surface;

moving said images through a plurality of development zones between said developer structures and said charge retentive surface;

developing said images with a plurality developer structures, each including a donor member for conveying charged toner particles of a different color from the other developer structures for depositing toner particles in a spot on spot manner onto said latent electrostatic images;

electrically biasing each of said developer structures;

controlling the electrical bias for each developer structure at different voltage levels whereby varying amounts of toner may be deposited on said latent electrostatic images from each of said developer structures in accordance with the color of the image to be created generating signals representative of the surface potential of the donor member for each of said developer structure; and using said signals for adjusting the biases applied to said developer structures for compensating for the effects of said surface potential on each development structure.

9. The method according to claim 8 wherein said step of applying electrical biases comprises applying successively larger biases to each of said developer structures.

10. The method according to claim 8 wherein the donor member for each of said developer structures comprises a belt.

* * * * *